US007472807B1

(12) United States Patent
Black

(10) Patent No.: US 7,472,807 B1
(45) Date of Patent: Jan. 6, 2009

(54) SODA DISPENSING APPARATUS

(76) Inventor: Jason K. Black, 7125 W. 3500 South, West Valley City, UT (US) 84128

( * ) Notice: Subject to any disclaimer, the term of this patent is extended or adjusted under 35 U.S.C. 154(b) by 554 days.

(21) Appl. No.: 11/112,559

(22) Filed: Apr. 25, 2005

(51) Int. Cl.
*B67D 5/06* (2006.01)

(52) U.S. Cl. ..... 222/185.1; 222/129; 222/481.5; 141/362; 141/364

(58) Field of Classification Search ..... 222/129, 222/185.1, 481.5; 141/360–366, 351, 357
See application file for complete search history.

(56) References Cited

U.S. PATENT DOCUMENTS 2,562,212 A * 7/1951 Rogers et al. ..... 222/113
2,567,282 A * 9/1951 Gardner et al. ..... 222/363
4,293,082 A * 10/1981 Matsueda ..... 222/131
5,111,966 A * 5/1992 Fridman ..... 222/1
5,335,829 A 8/1994 Sovann
5,405,058 A 4/1995 Kalis et al.
D363,634 S 10/1995 Cohn
5,577,638 A * 11/1996 Takagawa ..... 222/185.1
5,683,015 A * 11/1997 Lee ..... 222/146.6
5,791,517 A 8/1998 Avital
5,848,736 A 12/1998 Boumann
5,947,333 A 9/1999 Hoffmann et al.
7,040,515 B2 * 5/2006 Cote ..... 222/481.5
2002/0070234 A1 * 6/2002 Sunnarborg ..... 222/129
2002/0170921 A1 * 11/2002 Tan et al. ..... 222/67

* cited by examiner

*Primary Examiner*—J. Casimer Jacyna

(57) ABSTRACT

A soda dispensing apparatus includes a housing having a bottom wall and a peripheral wall that is attached to and extends upwardly from the bottom wall. The peripheral wall has an aperture extending therethrough. The aperture is positioned generally adjacent to the bottom wall and extends upwardly from the bottom wall. An upper edge of the peripheral wall defines an opening into the housing. A concave saddle is positioned in the housing adjacent to the opening. The saddle has an open bottom side. The saddle has a size and shape adapted for receiving a soda bottle so that a threaded opening of the bottle extends through the open bottom side. A spout assembly is removably attached to the threaded opening and is selectively opened or closed. An actuator is mounted in the housing that selectively opens the spout assembly so that fluid flows outwardly of the threaded opening.

17 Claims, 5 Drawing Sheets

SODA DISPENSING APPARATUS

BACKGROUND OF THE INVENTION

1. Field of the Invention

The present invention relates to soda dispensing devices and more particularly pertains to a new soda dispensing device for selectively dispensing soda out of a conventional soda bottle.

2. Description of the Prior Art

The use of soda dispensing devices is known in the prior art. U.S. Pat. No. 5,791,517 describes a device for attaching to a soda bottle for dispending soda out of the bottle. Another type of soda dispensing device is found in U.S. Pat. No. 5,405,058 which again includes a threaded opening assembly which is attachable to a soda bottle for selectively dispensing therefrom. Yet another such device is found in U.S. Pat. No. 5,335,829 which is adapted for holding a plurality of bottles. A similar device is found in U.S. Pat. No. 5,947,333 which has a design particularly well suited for the dispensing of fluids which are contained in bags.

While these devices fulfill their respective, particular objectives and requirements, the need remains for a device that holds a conventional two litter soda bottle in an inverted position so that soda may be selectively poured from the bottle. This will allows for easy pouring without the need for picking up the soda bottle and without the need to continuously remove and replace the cap of the soda bottle to prevent loss of carbonation.

SUMMARY OF THE INVENTION

The present invention meets the needs presented above by generally comprising a housing having a bottom wall and a peripheral wall that is attached to and extends upwardly from the bottom wall. The peripheral wall has an aperture extending therethrough. The aperture is positioned generally adjacent to the bottom wall and extends upwardly from the bottom wall. An upper edge of the peripheral wall defines an opening into the housing. A concave saddle is positioned in the housing adjacent to the opening. The saddle has an open bottom side. The saddle has a size and shape adapted for receiving a soda bottle so that a threaded opening of the bottle extends through the open bottom side. A spout assembly is removably attached to the threaded opening and is selectively opened or closed. An actuator is mounted in the housing that selectively opens the spout assembly so that fluid flows outwardly of the threaded opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
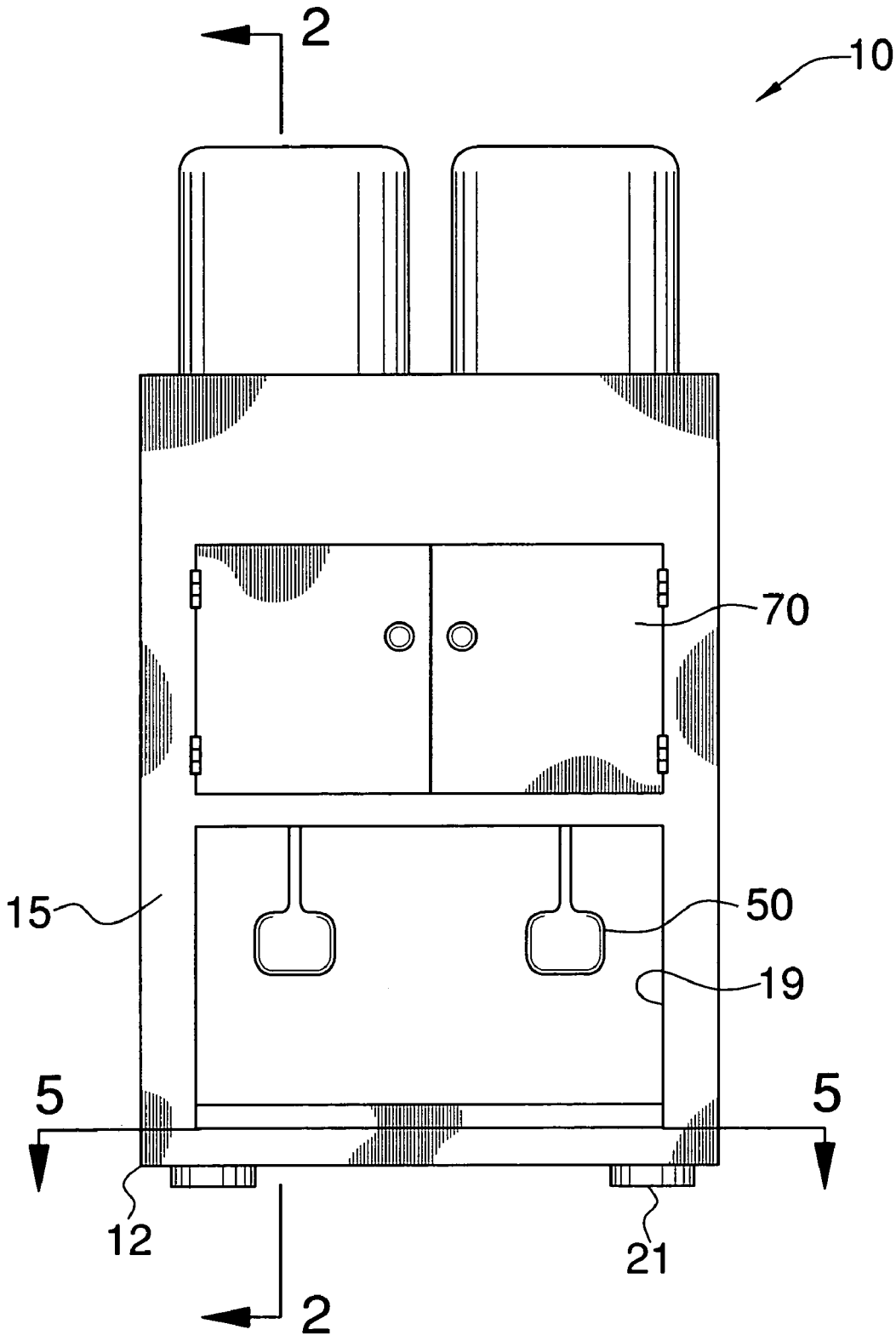
FIG. 1 is a front view of a soda dispensing apparatus according to the present invention.
Figure 2:
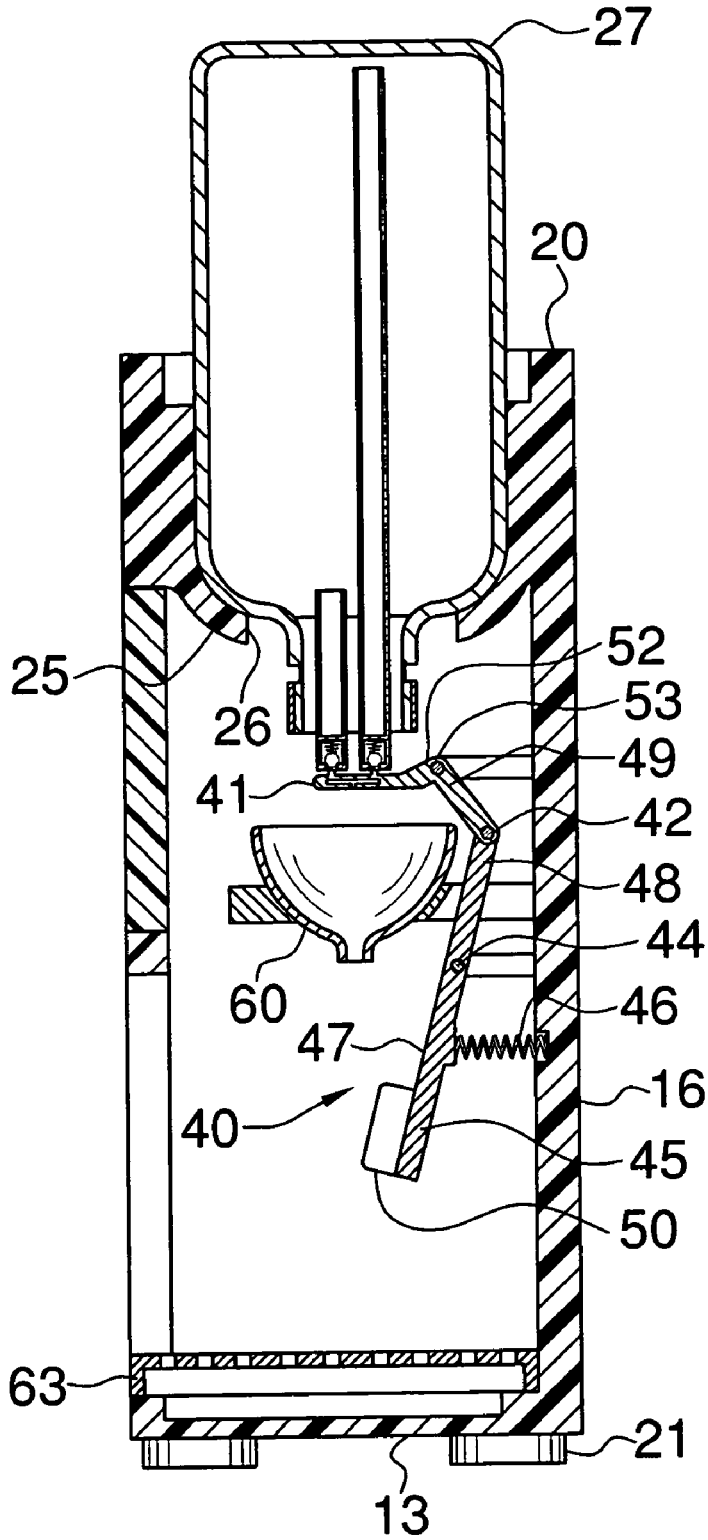
FIG. 2 is a cross-sectional view taken along line 2-2 of FIG. 1 of the present invention.
Figure 3:
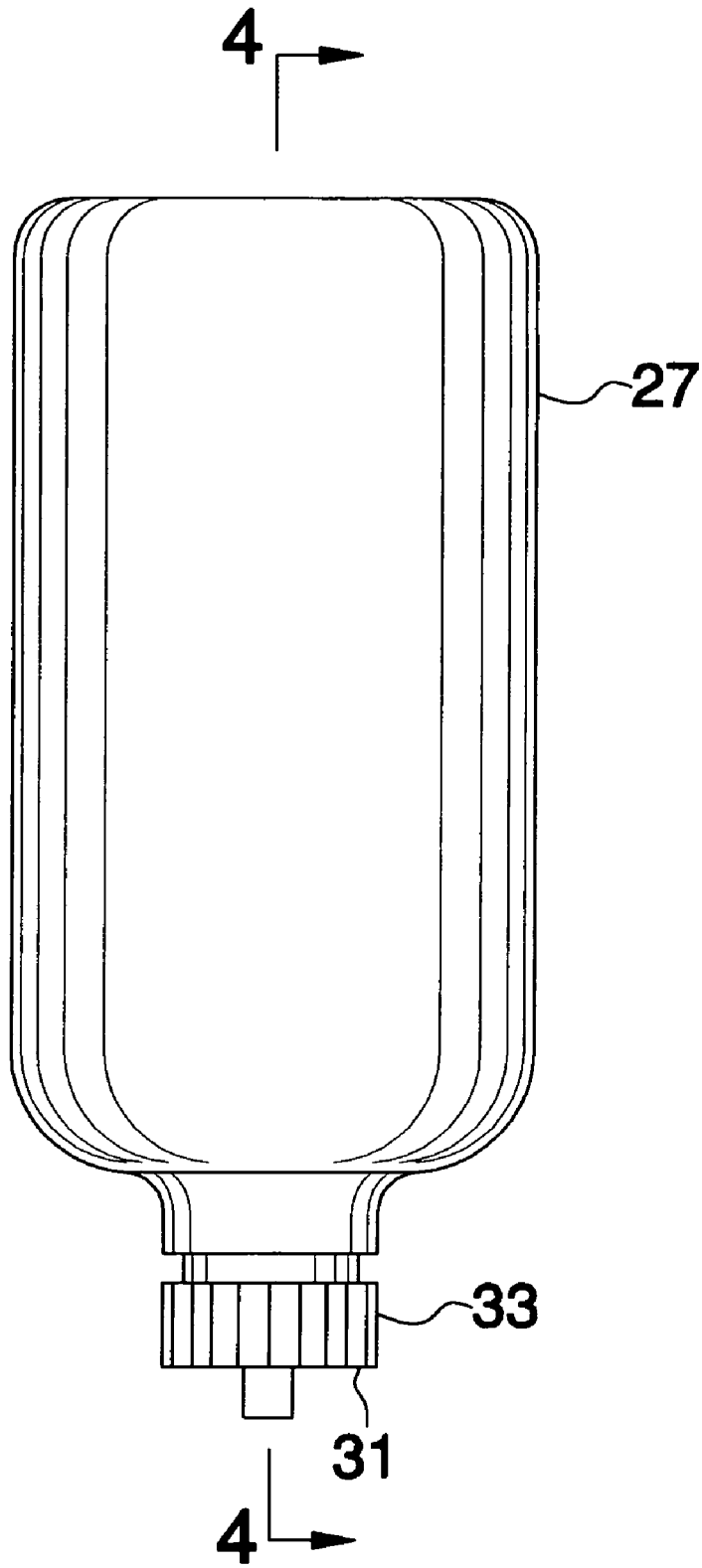
FIG. 3 is a side view of a soda bottle of the present invention.
Figure 4:
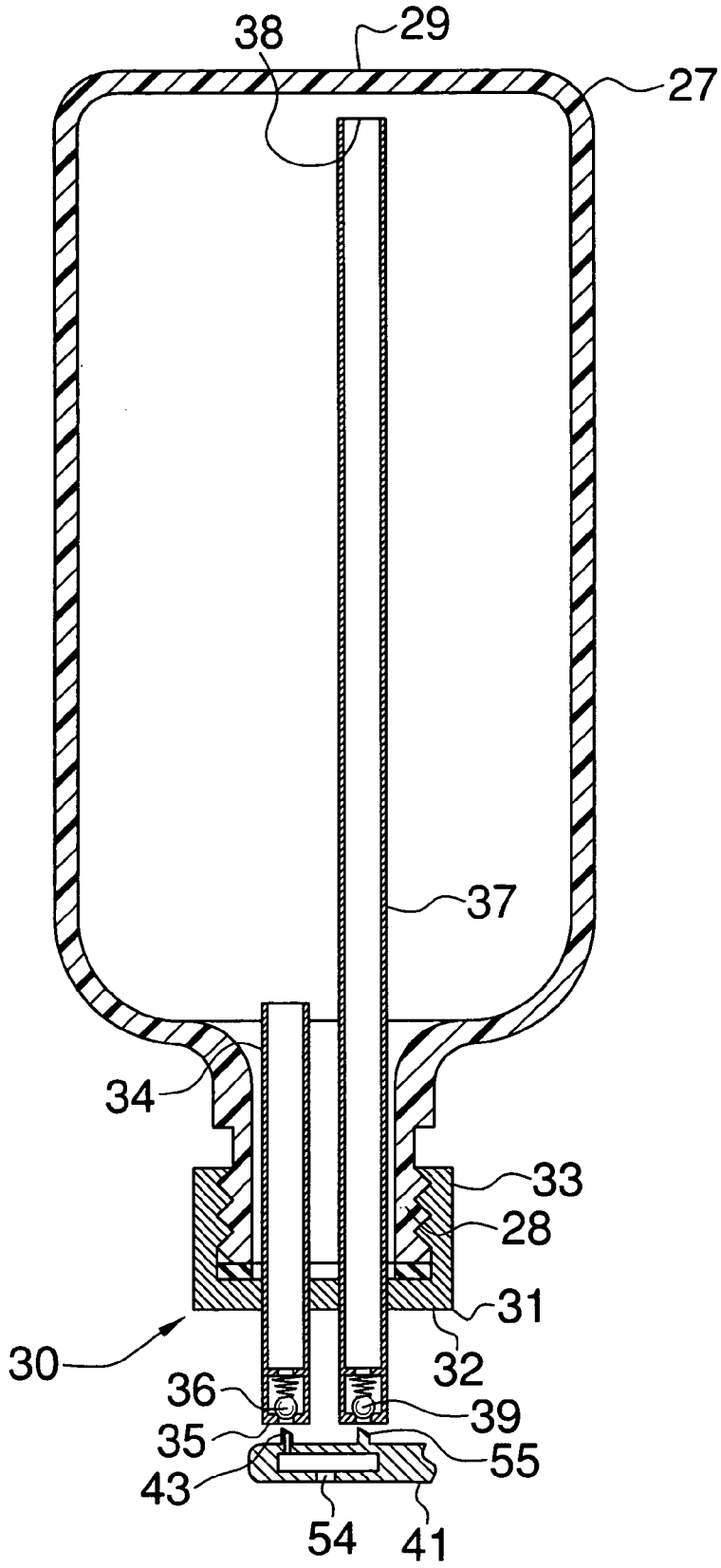
FIG. 4 is a cross-sectional view taken along line 4-4 of FIG. 3 of the present invention.
Figure 5:
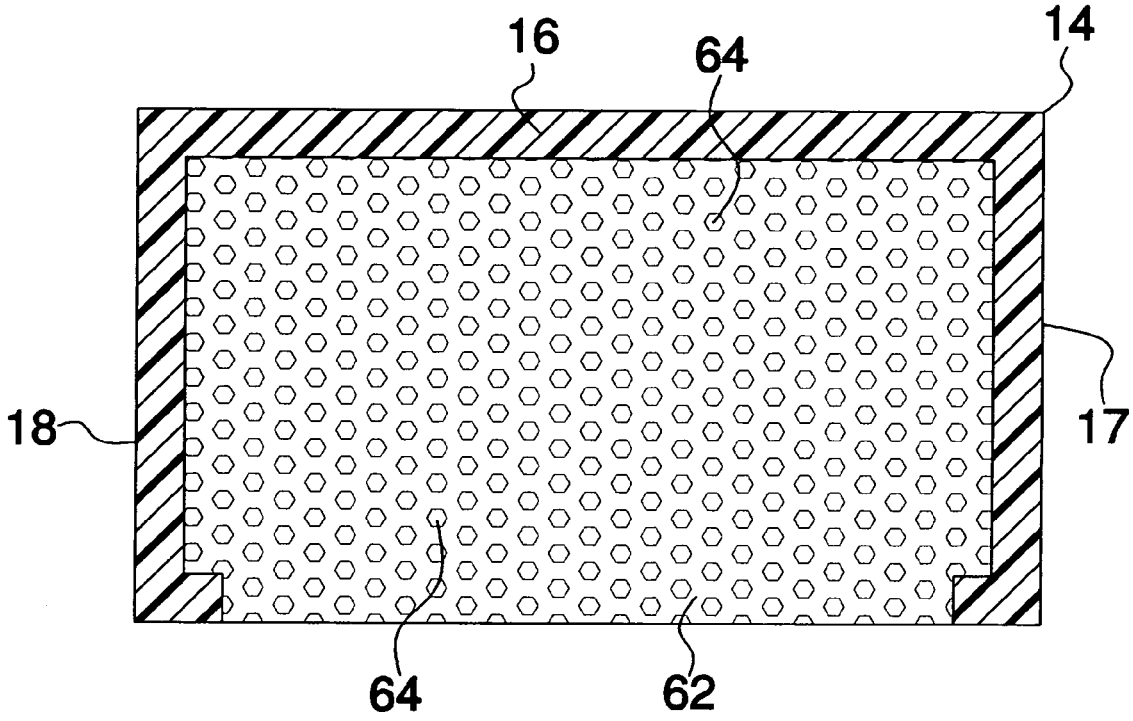
FIG. 5 is a cross-sectional view taken along line 5-5 of FIG. 1 of the present invention.

With reference now to the drawings, and in particular to FIGS. 1 through 5 thereof, a new soda dispensing device embodying the principles and concepts of the present invention and generally designated by the reference numeral 10 will be described.

As best illustrated in FIGS. 1 through 5, the soda dispensing apparatus 10 generally comprises a housing 12 that has a bottom wall 13 and a peripheral wall 14 that is attached to and extending upwardly from the bottom wall 13. The peripheral wall 14 includes a front wall 15, a rear wall 16, a first side wall 17 and a second side wall 18. The front wall 15 has an aperture 19 extending therethrough. The aperture 19 is positioned generally adjacent to the bottom wall 13 and extends upwardly from the bottom wall 13. An upper edge 20 of the peripheral wall 14 defines an opening into the housing 12. A plurality of supports 21 is attached to and extends downwardly away from the bottom wall 13.

A concave saddle 25 is positioned in the housing 12 adjacent to the opening, or upper edge 20. The saddle 25 is arced downwardly toward the bottom wall 13. The saddle 25 has an open bottom side 26. The saddle 25 has a size and shape adapted for receiving a soda bottle 27 so that a threaded opening 28 of the bottle 27 extends through the open bottom side 26.

A spout assembly 30 is removably attached to the threaded opening 28 and is selectively opened or closed. The spout assembly 30 includes a cap 31 including an end wall 32 and a perimeter wall 33 attached to the end wall 32. The perimeter wall 33 is threaded and is adapted for threadably coupling to the threaded opening 28 of a conventional two liter soda bottle 27. A pour tube 34 extends through the end wall 32. The pour tube 34 has a length less than three inches. The pour tube 34 has an outer end 35 extending outward of the bottle 27 when the cap 31 is coupled to the threaded opening 28. A one way valve 36 is fluidly coupled to the pour tube 34 and is adapted for selectively allowing fluid to flow outwardly of the pour tube 34. An air tube 37 extends through the end wall 32. The air tube 37 has a length greater than 10 inches. The air tube 37 has an upper end 38 positioned adjacent to a lower wall 29 of the bottle 27 when the cap 31 is coupled to the threaded opening 28. A second one-way valve 39 may be fluidly coupled to the air tube 37.

An actuator 40 is mounted in the housing 12. The actuator 40 is adapted for selectively opening the spout assembly 30 so that fluid flows outwardly of the threaded opening 28. The actuator 40 includes a head 41 and a lever 42 attached together. The head 41 has a post 43 thereon. The lever 42 is pivotally coupled in the housing 12 at a pivot point 44 and has a free end 45 that is accessible through the aperture. The post 43 is extendable into the pour tube 34 so that the valve 36 is placed in an open position. The lever 42 is biased away from the back wall 16 with a spring 46 and the head 41 is moved toward the threaded opening 28 when the lever 42 is pushed toward the back wall 16. The lever 42 includes a lower section 47 attached with to the pivot point 44. The lower section 47 has an upper end 48 hingedly coupled to an upper section 49 of the lever 42. An arcuate panel 50 is attached to the free end 45 of the lower section 47. The upper section 49 is also pivotally coupled to the housing 12. The upper section 49 has a free end 52 having the head 41 attached thereto. The upper section 49 has a bend 53 therein so that the free end 52 moves toward the saddle 25 when the panel 50 is moved toward the back wall 16. The head 41 may be hollow with the post 43 defining a conduit fluidly coupled to an interior of the head 41. A drain opening 54 extends downwardly out of the head 41 so that fluid may enter the head 41 through the post 43 and exit through the drain opening 54. A rod 55 may be attached to the head 41 for engaging the second one-way valve 39 to allow air to enter the soda bottle 27.

A funnel 60 is mounted in the housing 12 and is positioned below the saddle 25 so that fluid poured outwardly of the bottle 27 pours into the funnel 60. The funnel 60 ensures that a steady stream of soda pours into a cup placed below the funnel 60.

A tray 62 is removably positionable on the bottom wall 13. The tray 62 has a support 63 attached thereto so that the tray 62 is positioned above the bottom wall 13. The tray 62 has a plurality of holes 64 extending therethrough. The tray 62 allows soda to fall through to the bottom wall 13 so that it does not flow outwardly of the housing 12.

In use, the apparatus 10 is adapted for receiving a conventional soda bottle 27 so that soda may be dispensed therefrom. This allows a person to pour soda without having to continuously remove and replace a cap of the bottle 27. As shown in FIG. 1, the apparatus 10 may include a pair of soda pouring devices. Additionally, the front wall 15 may include a pair of doors 70 therein for accessing an interior of the housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soda bottle dispensing system comprising:

a housing having a bottom wall and a peripheral wall being attached to and extending upwardly from said bottom wall, said peripheral wall having an aperture extending therethrough, said aperture being positioned generally adjacent to said bottom wall and extending upwardly from said bottom wall, an upper edge of said peripheral wall defining an opening into said housing;

a concave saddle being positioned in said housing adjacent to said opening, said saddle having an open bottom side, said saddle having a size and shape adapted for receiving a soda bottle such that a threaded opening of the bottle extends through the open bottom side;

a spout assembly being removably attached to the threaded opening and being selectively opened or closed;

an actuator being mounted in said housing, said actuator selectively opening said spout assembly such that fluid flows outwardly of the threaded opening;

a funnel being mounted in said housing and being positioned below said saddle such that fluid poured outwardly of the bottle pours into the funnel, said funnel having an upper edge forming an entry into said funnel, said upper edge being spaced from saddle and defining an unencumbered free edge allowing airflow in a space between said saddle and said funnel, said funnel having an open bottom end; and said spout assembly including a cap having an end wall and a perimeter wall attached to said end wall, said perimeter wall being threaded and being adapted for threadably coupling to the threaded opening, a pour tube extending through said end wall, said pour tube having a length less than three inches, said pour tube having an outer end extending outward of the bottle when said cap is coupled to the threaded opening, a one way valve being fluidly coupled to said pour tube and being adapted for selectively allowing fluid to flow outwardly of said pour tube.

2. The system according to claim 1, wherein said saddle is arced downwardly toward said bottom wall.

3. The system according to claim 1, further including an air tube extending through said end wall.

4. The system according to claim 3, wherein said air tube has a length greater than 10 inches, said air tube having an upper end positioned adjacent to a lower wall of the bottle when said cap is coupled to the threaded opening.

5. The system according to claim 1, wherein said actuator includes a head and a lever attached together, said head having a post thereon, said lever being pivotally coupled in said housing and having a free end being accessible through said aperture, wherein said post is extendable into said pour tube such that said valve is placed in an open position.

6. The system according to claim 1, further including a tray being removably positionable on said bottom wall, said tray having a support attached thereto such that said tray is positioned above said bottom wall, said tray having a plurality of holes extending therethrough.

7. The system according to claim 5, further including an air tube extending through said end wall.

8. The system according to claim 7, further including a second one-way valve being positioned in said air tube, a rod being attached to said head, said rod being extendable into said air tube such that said second one-way valve is place in an open position.

9. A soda bottle dispensing system comprising:

a housing having a bottom wall and a peripheral wall being attached to and extending upwardly from said bottom wall, said peripheral wall including a front wall, a rear wall, a first side wall and a second side wall, said front wall having an aperture extending therethrough, said aperture being positioned generally adjacent to said bottom wall and extending upwardly from said bottom wall, an upper edge of said peripheral wall defining an opening into said housing;

a concave saddle being positioned in said housing adjacent to said opening, said saddle being arced downwardly toward said bottom wall, said saddle having an open bottom side, said saddle having a size and shape adapted for receiving a soda bottle such that a threaded opening of the bottle extends through the open bottom side;

a spout assembly being removably attached to the threaded opening and being selectively opened or closed, said spout assembly including a cap including an end wall and a perimeter wall attached to said end wall, said perimeter wall being threaded and being adapted for threadably coupling to the threaded opening, a pour tube extending through said end wall, said pour tube having a length less than three inches, said pour tube having an outer end extending outward of the bottle when said cap is coupled to the threaded opening, a one way valve being fluidly coupled to said pour tube and being adapted for selectively allowing fluid to flow outwardly of said pour tube, an air tube extending through said end wall, said air tube having a length greater than 10 inches, said air tube having an upper end positioned adjacent to a lower wall of the bottle when said cap is coupled to the threaded opening;

an actuator being mounted in said housing, said actuator being adapted for selectively opening said spout assembly such that fluid flows outwardly of the threaded opening, said actuator including a head and a lever attached together, said head having a post thereon, said lever being pivotally coupled in said housing and having a free end being accessible through said aperture, wherein said post is extendable into said pour tube such that said valve is placed in an open position;

a funnel being mounted in said housing and being positioned below said saddle such that fluid poured outwardly of the bottle pours into the funnel, said funnel having an upper edge forming an entry into said funnel, said upper edge being spaced from saddle and defining an unencumbered free edge allowing airflow in a space between said saddle and said funnel, said funnel having an open bottom end; and a tray being removably positionable on said bottom wall, said tray having a support attached thereto such that said tray is positioned above said bottom wall, said tray having a plurality of holes extending therethrough.

10. A soda bottle dispensing system comprising:

a housing having a bottom wall and a peripheral wall being attached to and extending upwardly from said bottom wall, said peripheral wall having an aperture extending therethrough, said aperture being positioned generally adjacent to said bottom wall and extending upwardly from said bottom wall, an upper edge of said peripheral wall defining an opening into said housing;

a concave saddle being positioned in said housing adjacent to said opening, said saddle having an open bottom side, said saddle having a size and shape adapted for receiving a soda bottle such that a threaded opening of the bottle extends through the open bottom side;

a spout assembly being removably attached to the threaded opening and being selectively opened or closed;

an actuator being mounted in said housing, said actuator selectively opening said spout assembly such that fluid flows outwardly of the threaded opening;

a funnel being mounted in said housing and being positioned below said saddle such that fluid poured outwardly of the bottle pours into the funnel, said funnel having an upper edge forming an entry into said funnel, said upper edge being spaced from saddle and defining an unencumbered free edge allowing airflow in a space between said saddle and said funnel, said funnel having an open bottom end; and a tray being removably positionable on said bottom wall, said tray having a support attached thereto such that said tray is positioned above said bottom wall, said tray having a plurality of holes extending therethrough.

11. The system according to claim 10, wherein said saddle is arced downwardly toward said bottom wall.

12. The system according to claim 10, wherein said spout assembly includes a cap having an end wall and a perimeter wall attached to said end wall, said perimeter wall being threaded and being adapted for threadably coupling to the threaded opening, a pour tube extending through said end wall, said pour tube having a length less than three inches, said pour tube having an outer end extending outward of the bottle when said cap is coupled to the threaded opening, a one way valve being fluidly coupled to said pour tube and being adapted for selectively allowing fluid to flow outwardly of said pour tube.

13. The system according to claim 12, further including an air tube extending through said end wall.

14. The system according to claim 13, wherein said air tube has a length greater than 10 inches, said air tube having an upper end positioned adjacent to a lower wall of the bottle when said cap is coupled to the threaded opening.

15. The system according to claim 12, wherein said actuator includes a head and a lever attached together, said head having a post thereon, said lever being pivotally coupled in said housing and having a free end being accessible through said aperture, wherein said post is extendable into said pour tube such that said valve is placed in an open position.

16. The system according to claim 15, further including an air tube extending through said end wall.

17. The system according to claim 16, further including a second one-way valve being positioned in said air tube, a rod being attached to said head, said rod being extendable into said air tube such that said second one-way valve is place in an open position.

* * * * *